US008203484B2

(12) United States Patent
Chu et al.

(10) Patent No.: US 8,203,484 B2
(45) Date of Patent: Jun. 19, 2012

(54) PATH-SHARING TRANSCEIVER ARCHITECTURE FOR ANTENNA ARRAYS

(75) Inventors: Ta-Shun Chu, Los Angeles, CA (US); Hossein Hashemi, Los Angeles, CA (US)

(73) Assignee: University of Southern California, Los Angeles, CA (US)

( * ) Notice: Subject to any disclaimer, the term of this patent is extended or adjusted under 35 U.S.C. 154(b) by 396 days.

(21) Appl. No.: 12/029,253

(22) Filed: Feb. 11, 2008

(65) Prior Publication Data

US 2008/0252524 A1 Oct. 16, 2008

Related U.S. Application Data

(60) Provisional application No. 60/900,420, filed on Feb. 9, 2007.

(51) Int. Cl.
*H01Q 3/22* (2006.01)

(52) U.S. Cl. ..... 342/375

(58) Field of Classification Search ..... 342/81, 342/157, 368, 372, 375; 375/295, 308
See application file for complete search history.

(56) References Cited

U.S. PATENT DOCUMENTS 7,009,560 B1 * 3/2006 Lam et al. ..... 342/375
2003/0161411 A1 8/2003 McCorkle et al.
2004/0235497 A1 11/2004 Zekavat

OTHER PUBLICATIONS

Bass, J.; Rodriguez, E.; Finnigan, J.; McPheeters, C.; Beanforming basics. Connexions. Jul. 27, 2005.
International Search Report for PCT Application Serial No. PCT/US08/53592, mailed on Sep. 24, 2008.

* cited by examiner

*Primary Examiner* — Dao Phan
(74) *Attorney, Agent, or Firm* — McDermott Will & Emery LLP

(57) ABSTRACT

A path sharing transceiver array architecture is disclosed. A plurality of channels are linked to antennas of an array for transmitting and receiving wireless signals that are offset in one of phase or time relative to one another. Each channel is associated with a delay element. In the receiving case, an offset signal is received at a first channel, processed, and shifted by a first delay element. The resulting signal is combined with the processed signal of a second, adjacent channel where a phase or time delayed signal is received. The combined signal is then shifted by a second delay element to produce a net signal. The first delay element is used to generate a shifted signal for both the first and second channel. The architecture can be extended to another number of channels.

39 Claims, 13 Drawing Sheets

PATH-SHARING TRANSCEIVER ARCHITECTURE FOR ANTENNA ARRAYS

CROSS-REFERENCE TO RELATED APPLICATION

This application claims priority to U.S. Provisional Patent Application Ser. No. 60/900,420, entitled "Novel Path-Sharing True Time Delay Transceiver Architecture For Ultra Wideband Antenna Arrays," filed Feb. 9, 2007, the contents of which are incorporated herein by reference in their entirety.

BACKGROUND

1. Field of the Invention

The present invention relates generally to wireless signal processing, and more specifically to circuit techniques for processing signals over antenna arrays.

2. Description of Related Art

The recent proliferation of ultra-wideband (UWB) communication and imaging applications has been widespread in both military and commercial arenas. The utilization of ultra short pulses in time domain, corresponding to ultra wide bandwidth in frequency domain, increases data rate and range resolution in wireless communication and imaging applications, respectively. UWB waves operating at the FCC allocated frequencies propagate through materials with much less attenuation than compared with microwave and optical signals; therefore, UWB imaging systems are ideal for wall and ground penetrating applications and for poor weather conditions. In addition, the power consumption and cost of UWB is usually lower compared to its conventional narrowband counterparts due to UWB's comparatively simpler detection schemes. UWB-based applications include high data rate and secure wireless communications, high resolution radar, biomedical, surgical and environmental imaging, and many others.

The use of multiple antenna transceivers in communications and imaging applications (including UWB) offers spatial diversity and increases communication capacity. In imaging applications using an array of antenna transceivers, a sequence of pulses is transmitted towards and reflects off of the target. The receiver collects the reflected signals and reconstructs the image.

A phased array is a group of narrowband antenna arrays where a sinusoidal plane wave reaches each antenna element with a different phase as a function of incident angle. Variable phase shifters may be used in each path to compensate for the phase offset caused by the propagation delay difference. Depending on the phase shifter settings, the combined received signal of all paths is reinforced in the desired direction and suppressed in the undesired directions.

Timed arrays can be used to enhance the amplitude of a received UWB signal derived from a propagating wavefront. A timed array is a group of antennas in which the relative arrival times at the antennas of the wideband signals vary depending on the propagating wavefront's incident angle. Using delay elements, earlier arriving signals are selectively delayed by variable amounts to produce time-shifted or time compensated signals. The time-shifted signals are added together to form a coherent resulting signal. These procedures occur in such a way that the effective radiation pattern of the array is reinforced in a desired direction and suppressed in undesired directions. Timed arrays effectively function as spatial filters, electronically steering the beam towards specific directions to receive signals. Timed arrays can improve receiver signal-to-noise ratios and can also reduce output power requirements.

In conventional architectures, a variable true-time-delay (TTD) element is required for each path of the UWB timed array to compensate for the propagation delay differences. The time delay can be varied by routing the UWB signal through different lengths of transmission lines, which can reside on an integrated circuit chip. FIG. 1 depicts an example of a conventional UWB timed array 100. The timed array 100 includes antenna elements A0-A3, each coupled, respectively, to variable delay elements TTD0-TTD3 and combining element C0. A propagating wave $\delta$ is received at antenna components A0-A3 at an incident angle of $\alpha$ as signals $\delta_0$-$\delta_3$. Here it is assumed that incident angle $\alpha$ results in time delays of magnitude $\tau$, $2\tau$, and $3\tau$ between the arrival at antenna element A0 of signal element $\delta_0$, and the arrivals at antenna elements A1-A3 of received signals $\delta_1$-$\delta_3$, respectively. The antenna array in this example has a beam array pattern 110 as shown, which is in the same direction as the incident wavefront. The delay elements TTD0-TTD3 each include variable delay paths which introduce different delays into signals $\delta_0$-$\delta_3$ of 0 through $3\tau$ seconds, respectively, to compensate for the arrival time differences of the four signals. The time-shifted signals $\delta_{0TS}$-$\delta_{3TS}$ are summed together in combining element C0 to produce the coherent received signal $\delta_C$.

While four stages are shown, another number of stages is possible. Further, while a receive technique is demonstrated here, timed array 100 also functions in the same way as a transmitter, with $\delta_C$ instead being the UWB input waveform and C0 a splitter for dividing the signal.

The array of FIG. 1 can alternatively be viewed as a phased array 100 receiving or transmitting a narrowband waveform $\delta$ (e.g., a sinusoid). Here, variable phase shifters would be substituted for TTD0-TTD3.

Of particular interest to designers is the development of an integrated UWB timed array. One challenge in the realization of a such an array is the effective implementation of the variable TTD structure. Ideally, the variable TTD should have a small delay resolution in order to achieve high scanning resolution in the array, while having a large total delay to compensate for the delay difference between near and far elements in a large array.

The delay of an electromagnetic wave may be varied by manipulating either the propagation length or the wave velocity. A delay element may use a long delay path, such as an electrical trombone line, to increase the propagation length. However, such an implementation would require an impractically large amount of semiconductor space, as well as consume an excess amount of power. Alternatively, a delay element may rely on changing wave velocity such as by changing the dielectric material. Unfortunately, the transmission line characteristic impedance also varies while modifying the wave velocity, leading to unwanted reflection characteristics at different delay setting.

A similar challenge persists for artisans to develop a more compact, power efficient transceiver circuit for processing narrowband signals. Like the variable TTD elements referenced above, variable phase shifter elements take up space. Conventional approaches require that multiple such elements be used and duplicated to realize existing phased arrays.

In short, the large size and high cost of integrated variable TTD blocks and phase shifters become major issues in conventional narrowband and broadband array architectures.

SUMMARY

The present disclosure is directed to signal processing techniques suitable for timed arrays and phased arrays. This architecture allows coherent beam-forming.

A circuit for processing wireless signals may include a plurality of channels, each including an input stage for processing a wireless signal received at a respective antenna of an array, the received signals being offset in time or phase relative to one another, and a delay element coupled to each input stage, the delay element comprising a delay path for producing a shifted signal, wherein a delay path on one channel is used to generate a shifted signal on an adjacent channel.

An integrated circuit for processing ultra-wideband signals may include a plurality of channels for conditioning received ultra-wideband signals, the signals being shifted in time relative to one another, and a delay element on each channel for producing a time shifted signal, wherein a common delay element is used to produce time-shifted signals on more than one channel.

A timed array receiver may include first and second spatially adjacent antennas of a plurality of antennas in an array, the first and second antennas configured to receive first and second wireless signals, respectively, the signals originating from an incident wavefront arriving at the antennas at a time delay relative to one another, the time delay being a function of an angle of the incidence, the first signal arriving first, first and second input stages respectively coupled to the first and second antennas for processing the first and second received signals, a first delay element coupled to the first input stage for producing a first time shifted signal from the first processed signal, a second delay element coupled to the second input stage for producing a second time shifted signal, wherein the second time shifted signal comprises a combination of the first time shifted signal and the second processed signal.

A circuit for processing wireless signals may include a plurality of channels, each channel comprising an input, each input being configured to receive the signals via a linked array of antennas, the signals arriving at the array in sequence of one of phase or time as a function of an angle of an incident ultra-wideband wavefront, delay elements, each delay element configured to introduce a delay into an earlier received signal on one of the channels to provide a shifted signal to an adjacent channel on which a received signal is delayed in phase or time, and a combining element coupled to each delay element; wherein at least one common delay element is configured to introduce the delay into received signals on more than one channel to provide a shifted signal to the more than one channel.

A wireless transmitter may include a plurality of channels, each channel coupled to an antenna in an array, a first delay element configured to generate a first shifted signal from a first input signal on a first channel, the first shifted signal being split into first and second split shifted signals, and a second delay element configured to generate a second shifted signal from the second split shifted signal on a second channel, the second shifted signal being split into second and third split shifted signals, wherein the first and second split shifted signals are transmitted over the antennas coupled to the first and second channels, respectively.

An ultra-wideband integrated receiver circuit may include a plurality of conducting terminals for coupling to an array of antenna elements, each antenna element for receiving an ultra-wideband signal, input processing circuits coupled to each conducting terminal, variable delay means coupled to each of the input processing circuits for producing time-shifted signals, combining means coupled to each of the variable delay means for producing net signals, wherein at least one common variable delay means provides a common delay path used to produce time-shifted signals on more than one channel.

Other features and advantages of the present disclosure will be understood upon reading and understanding the detailed description of exemplary embodiments, described herein, in conjunction with reference to the drawings.

BRIEF DESCRIPTION OF THE DRAWINGS

Aspects of the disclosure may be more fully understood from the following description when read together with the accompanying drawings, which are to be regarded as illustrative in nature, and not as limiting. In the drawings, like elements are indicated by the same reference character(s). The drawings are not necessarily to scale, emphasis instead placed on the principles of the disclosure. In the drawings.

Figure 1:
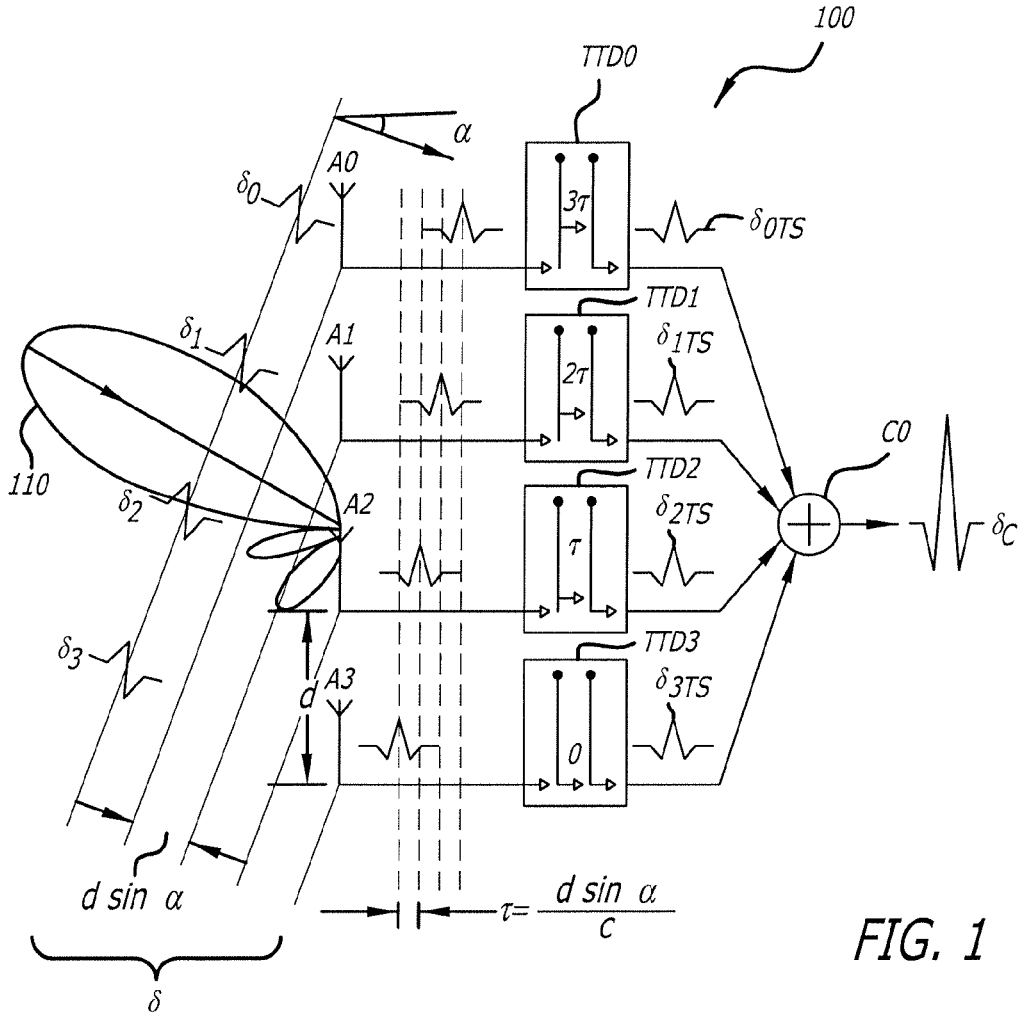
FIG. 1 (Prior Art)
FIG. 1 is a diagram of a conventional four channel timed array receiver.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION

In UWB antenna arrays, the incident pulse reaches different antenna elements at different times as a function of the incident angle. The time delay difference between the signal on two adjacent antenna elements, $\tau$, is a function of antenna spacing d and the incident angle $\alpha$ in accordance with the following relationship:

$$\tau = \frac{d\sin(\alpha)}{c} \tag{1.1}$$

where c is the velocity of light. In a UWB imaging system, the time difference as quantified by equation (1.1) may be compensated by using a variable true time delay element in each channel to time shift earlier arriving signals and thereby align the signals for coherent addition.

For purposes of this disclosure:

One channel is adjacent to another when then antennas to which the channels are coupled are spatially adjacent. Thus, in FIG. 1, A1 is adjacent to A0, A2 is adjacent to A1, and A3 is adjacent to A3.

The phrase "coupled to" is not intended to convey that a direct coupling is required.

The phrase "shifted signal" means either "time-shifted signal" or "phase-shifted signal" as appropriate.

Path Sharing Timed Array Architecture

Figure 2:
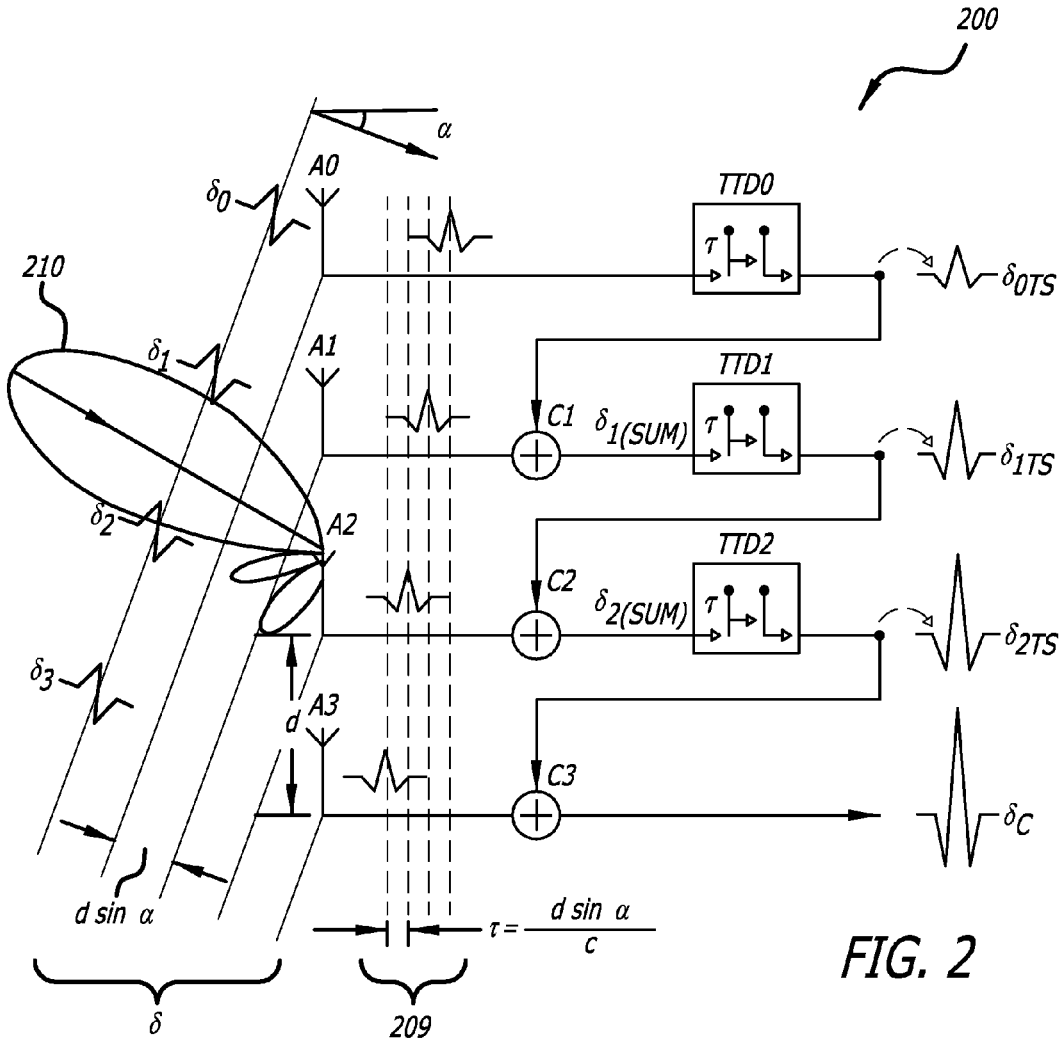
FIG. 2 is a diagram of a four channel timed array receiver using cascaded delay elements.

FIG. 2 is an illustration of a four channel path-sharing UWB timed array 200 in accordance with the present disclosure. Timed array 200 includes antenna elements A0-A3, variable true time delay elements TTD0-TTD2, and combining functions C1-C3. In certain implementations, including those described with respect to FIG. 4-7 herein, combining elements C1-C3 need not require discrete components. For example, the combining functionality may be realized as a consequence of the specific architecture of the delay elements as discussed below. In other embodiments, the combining functions may be realized as one or more discrete active or passive components.

For purposes of this illustration, timed array 200 includes four channels 0-3 linked to four antenna elements; however, it will be appreciated by those skilled in the art that the principles of this disclosure may extend to another number of channels and antenna elements.

Variable true time delay elements TTD0-TTD2 each contain, in one aspect, signal delay paths of varying lengths. The propagation delay of a signal traversing the delay path can be changed by varying the delay path. In one embodiment, discussed in greater detail with reference to FIGS. 4-6, the delay path includes an LC ladder using path select amplifiers. A digital control unit may select an amount of delay in each of TTD0-TTD2 by selecting the delay path. The selection of the delay path at any given time may depend on the expected incident waveform or other criteria relevant to the application.

A propagating wave $\delta$ approaches the antenna array A at an incident angle $\alpha$. The wave $\delta$ is received at antenna elements A0-A3 as signals $\delta_0$-$\delta_3$. Signal $\delta_0$ arrives at timed array 200 first, and is received at antenna element A0. Next, signals $\delta_1$-$\delta_3$ arrive in sequence at antennas A1-A3, at respective time delays governed by equation (1.1) above. Here it is assumed that the antenna spacing is equidistant so that the relative propagation delays of the received signals $\delta_0$, $\delta_1$, $\delta_2$, and $\delta_3$ are evenly distributed at times 0, $\tau$, $2\tau$, and $3\tau$, respectively. These delays are graphically illustrated by the vertically dashed lines 209 (although, the respective delays need not necessarily be an integer multiple of one another). The antenna spacing d is shown between antenna elements A2 and A3, and in this example the antenna spacing is equidistant for all for antennas. In general, however, the spacing between the antennas need not be equidistant and may vary with the application.

After each signal $\delta_0$-$\delta_3$ is received offset in time at its respective input, the signal may be provided to an input stage of one or more front end circuit modules (see FIGS. 4 and 5) for further processing. In an aspect, each signal is provided to a single channel 0-3 of a multi-channel UWB variable gain low-noise amplifier. The variable gain amplifier is a differential amplifier that amplifies the signal at each channel and may be used to compensate for loss differences between the signals at different channels.

Alternative implementations of the input stage are possible and are within the contemplation of those skilled in the art. The front end may involve the use of one or more comparators filters, amplifiers, processors, or other signal conditioning techniques to reduce signal interference, increase gain, and otherwise prepare the channels for proper delay compensation and coherent addition. In other configurations, the input stage may be part of the delay element, or may reside on another chip or component, or in another location. The channels may involve the use of either single-ended or differential inputs or outputs.

Illustrative array beam pattern 201 is also shown in FIG. 2. The array beam pattern 201 is a spatial pattern characteristic of the timed array 200. As described above, the combined received signal of all paths is reinforced in the desired direction and suppressed in undesired directions. For timed arrays in UWB applications such as described herein, the resulting array beam pattern may vary widely and may be dependent on a number of criteria, including, for example (1) the signal detection method employed, (2) the signal waveform type, (3) the signal bandwidth, (4) the antenna spacing d, and (5) the number of antenna elements. In this example, the array beam pattern is in the same direction as the incident wave $\delta$.

Antenna element A0 receives signal $\delta_0$ at a time $\tau$ seconds earlier than the time antenna element A1 receives signal $\delta_1$. Variable delay element TTD0 on channel 0 compensates for this time offset by adding an additional signal propagation delay of $\tau$ seconds to signal $\delta_0$, thereby producing time-shifted signal $\delta_{0TS}$. The signals that were received from antenna elements A0 on channel 0 and A1 on adjacent channel 1 are now aligned in the time domain as signals $\delta_{0TS}$ and $\delta_1$. These two signals are summed by combining function C1 to produce signal $\delta_{1(SUM)}$.

Locally combined signal $\delta_{1(SUM)}$, derived from signals received at antenna elements A0-A1 on respective channels 0-1, has a $\tau$ time offset relative to the signal $\delta_2$ on adjacent channel 2 received by antenna element A2. To compensate, variable delay element TTD1 adds a delay of $\tau$ seconds to signal $\delta_{1(SUM)}$, thereby producing time-shifted signal $\delta_{1TS}$. Signal $\delta_{1TS}$ from channel 1 and $\delta_2$ from adjacent channel 2 are summed by combining function C2 to produce signal $\delta_{2(SUM)}$.

Locally combined signal $\delta_{2(SUM)}$ on channel 2, derived from signals received at antenna elements A1-A2, has a $\tau$ time delay difference relative to the signal $\delta_3$ received by antenna A3 at adjacent channel 3. Variable delay element TTD2 adds a delay of $\tau$ seconds to signal $\delta_{2(SUM)}$, thereby producing time-shifted $\delta_{2TS}$. Signal $\delta_{2TS}$ from channel 2 and signal $\delta_3$ from channel 3 are summed by combining function C3 to produce signal $\delta_C$, which represents the resulting, coherently combined UWB signal.

It will be appreciated that the principles of FIG. 2 can be equally applied to a transmit procedure, using a splitting function in lieu of the combining functionality illustrated by C1-C3. In one embodiment, such as disclosed in FIG. 4 herein, the combining and splitting functions may be both performed in the context of the delay element and the quasi-distributed transmission line architecture. In the transmit case, a coherent UWB waveform input may be applied to the various delay elements and the resulting signals output from the array A0-A3 as a propagating wave of offset signals. A combination transmit/receive (i.e., transceiver) circuit may be realized by using, in one embodiment, the same components as conceptually that are illustrated in FIG. 2.

Figure 3:
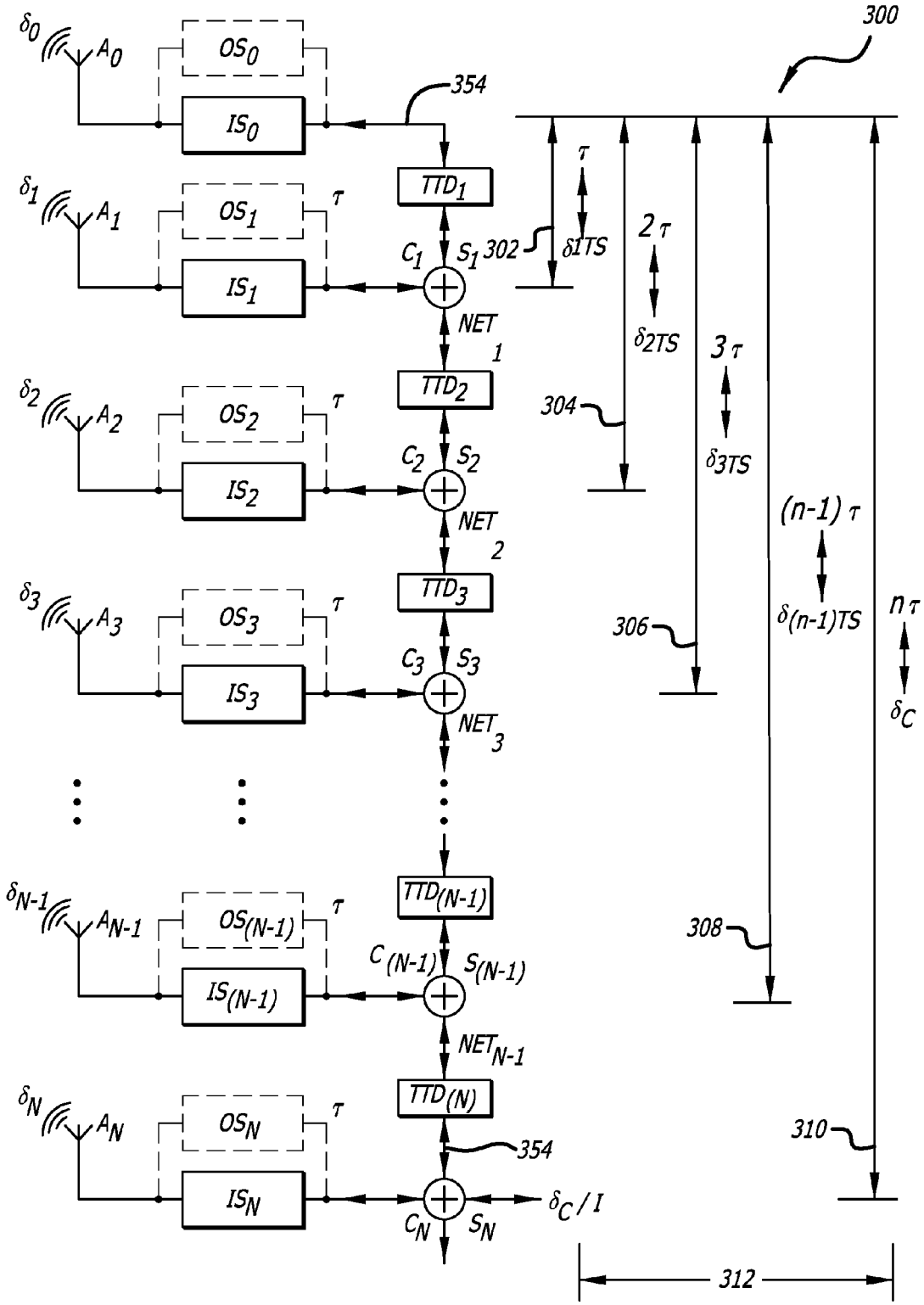
FIG. 3 is a diagram of an n-channel timed array transceiver.

In one embodiment, n input stages, n−1 signal combinations and n−1 variable TTD elements may be used to realize the transceiver architecture of the present disclosure. FIG. 3 shows an example of a generic path sharing timed array 300 for a multi-channel array of n antenna elements. Each channel 0-N is associated with a respective input stage $IS_0$-$IS_N$ for routing a signal in a multi-channel transceiver architecture, with each channel being associated with a particular input (or output) on which a UWB signal is received (or transmitted).

Each input stage $IS_0$-$IS_N$ may include a set of physical resources for receiving and processing a UWB signal. These resources vary depending on the application and may include components such as one or more input/output pads for linking to an external antenna, front end analog circuit components for signal filtering, amplification and conditioning, and digital circuits for digital signal processing. In other embodiments, input stages $IS_0$-$IS_N$ alternatively or additionally comprise a set of terminal connections with appropriately matched conducting paths for routing the UWB signals to other circuits for further processing. Input stages $IS_0$-$IS_N$ may be single ended or differential, or both techniques may be used.

A plurality of corresponding output stages $OS_0$-$OS_N$ may be connected in parallel with the input stages $IS_0$-$IS_N$ for transmitting UWB signals over the antenna array. The timed array architecture of FIG. 3 is a transceiver for performing both transmit and receive functions. Each output stage $OS_0$-$OS_N$ may include a set of physical resources for processing a UWB signal for transmission. Like the components that comprise input stages $IS_0$-$IS_N$, the components comprising the output stages $OS_0$-$OS_N$ may vary depending on the application (e.g., imaging versus communication), signal type (e.g., broadband versus narrowband), hardware specifications, power limitations, and other parameters.

FIG. 3 also shows an array of antennas $A_0$-$A_N$ coupled to the corresponding input stages $IS_0$-$IS_N$ and output stage $OS_0$-$OS_N$. Referring here to the input (receive) functions of FIG. 3 for purposes of illustration, the outputs of $IS_1$-$IS_N$ are coupled to one of the inputs of a corresponding array of combining functions $C_1$-$C_N$ (in one embodiment, the combining function is performed within the delay elements or may otherwise be performed passively by virtue of a quasi-distributed transmission line architecture). The outputs of variable delay elements TTD1-$TTD_N$ are combined as conceptually illustrated via respective combining functions $C_1$-$C_N$. The input of $TTD_0$ is fed by the output of $IS_0$. The inputs of variable delay elements $TTD_2$-$TTD_N$ are fed by the respective outputs of each of combining functions $C_1$-$C_{N-1}$. The outputs of combining functions $C_1$-$C_{N-1}$ are $NET_1$-$NET_{N-1}$, respectively. The output of combining function $C_N$ represents the coherently combined signal waveform $\delta_C$.

The circuit shown in FIG. 3 is similar to that shown in FIG. 2, except as generalized to n number of stages. It is assumed here, as in FIG. 2, that a delay offset $\tau$ is used to provide time-shifted signals as a result of some magnitude of incidence of the UWB wavefront $\delta$. It is also assumed that the input stages $IS_0$-$IS_N$ have been designed to be matched relative to one another with respect to impedance and propagation delay (as well as the remainder of the conducting paths of each of the signals), so that the integrity of the relationships between the signals traversing these stages is preserved at the relevant UWB frequencies.

As before, delay element $TTD_1$ is used to generate a time-shifted signal $\delta_{1TS}$ from input stage $IS_0$. Because of the local combining functions $C_1$-$C_N$ and the cascaded configuration of variable delay elements $TTD_1$-$TTD_N$, the time-shifted signal $\delta_{1TS}$ created by $TTD_1$ may also used in all subsequent input stages. That is, the delay path in variable delay element $TTD_1$ associated with input stage $IS_0$ may be shared for input stages $IS_0$-$IS_{N-1}$. Likewise, the delay path in variable delay element $TTD_1$ associated with input stage $IS_1$ is shared for input stages $IS_1$-$IS_{N-1}$. The delay path in variable delay element $TTD_{N-2}$, associated with input stage $IS_{N-2}$ (not shown) is shared for input stage $IS_{N-2}$ and $IS_{N-1}$. Generally speaking, the delay path for one channel can be shared for an adjacent channel, the delay path for that adjacent channel can be shared for the next adjacent channel, and so forth.

Vertical line set 312 illustrates this path sharing feature with reference to time delay $\tau$. Delay time $\tau$ ($TTD_1$) corresponds to time-shifted signal $\delta_{1TS}$ (302); delay time $2\tau$ ($TTD_1+TTD_2$) corresponds to time-shifted signal $\delta_{2TS}$ (304); delay time $3\tau$ ($TTD_1+TTD_2+TTD_3$) corresponds to time-shifted signal $\delta_{3TS}$ (306); delay time $(N-1)\tau$ ($TTD_1+TTD_2+TTD_3+\ldots+TTD_{(N-1)}$) corresponds to time-shifted signal $\delta_{(N-1)TS}$ (308); and delay time $N\tau$ ($TTD_1+TTD_2+TTD_3+\ldots+TTD_{(N-1)}+TTD_N$) corresponds to the resulting coherent UWB signal $\delta_C$ (310). Thus, a time-shifted signal from a first channel is combined and used on an adjacent channel, which combined signal in turn is used on an adjacent channel, etc.

It can be seen that, in FIGS. 2 and 3, a common delay element may be used to provide time shifted signals on more than one channel.

$NET_1$-$NET_{N-1}$ are signals that represent a combination of a time-shifted signal on one channel with a signal arriving on an adjacent channel. $NET_1$-$NET_{N-1}$ may be cascaded together as shown. Each of $NET_2$-$NET_{N-1}$ is configured to include time-shifted signals from more than one delay element (i.e., delay elements on channels associated with earlier arriving signals) in the manner described above.

Unlike the timed array of FIG. 1, the maximum required delay to be built into variable elements TTD0-TTD2 may be reduced. In particular, the cascade connection of variable delay elements and the local signal combining as illustrated in FIGS. 2 and 3 permits the delay paths to be shared, rather than reproduced as an independent module for each antenna element, as in FIG. 1. A reduction in the total required on-chip delay of n−1 may thereupon be achieved, where n is the number of stages. Accordingly, using the principles of the present disclosure, a significant reduction in chip area for an integrated circuit transceiver implementation may be achieved. Similar architectures for a stand alone integrated receiver timed array, or a transmitter timed array, may also benefit equally from the principles of this disclosure.

In addition, because the total length of the quasi-distributed transmission line may be reduced, the path-sharing implementation of the present disclosure may provide significant power savings benefits over conventional implementations.

Variations to the illustrated path sharing architecture may be suitable depending on the application and would be appreciated by those of skill in the art in light of the present disclosure. For instance, in one aspect, the path sharing may use a different number of summing circuits, variable delay elements, or both. Additional or different elements or circuit components may also be used to adjust or control different parameters, such as signal voltage and current characteristics, antenna beamwidth, electronic steering, beam array patterns, etc. One or more processing circuits may be coupled to the transceiver to perform any of these functions. Alternatively, some or all of these functions may be performed on chip.

The transceiver functionality of timed array 300 also enables for transmit functionality, as shown by the bidirectional nature of the arrows 354. For the transmit operation, a coherent input waveform I is input into splitting function $S_N$, which splits the signal into two signal components, the Nth component directed to output stage $OS_N$ to be wirelessly transmitted via antenna $A_N$ and the (N−1) component directed to delay element $TTD_{(N)}$ where it is time-shifted (e.g., by $\tau$ s). The (N−1) component is thereupon split again into an (N−1) component and an (N−2) component. The (N−1) component is routed on output stage $OS_{(N-1)}$ for transmission via antenna $A_{(N-1)}$. The (N−2) component is time-shifted, split, and transmitted in the manner described above, until all components are transmitted on all channels.

While the principles of the present disclosure have unique suitability for narrowband UWB applications, it will be appreciated that the path sharing techniques described herein may be applied to any type of narrowband or wideband wireless technologies where an increase in circuit performance is desired. Moreover, while the example in FIG. 3 is that of a timed array using variable time delay elements, the principles of FIG. 3 are equally applicable to phased arrays using variable phase delay elements. In the latter case, in lieu of using each of delay elements $TTD_1$-$TTD_N$ for generating a time-shifted signal from a processed signal on each relevant channel, variable phase shifters may be substituted for generating a phase shift in a narrowband signal such as a sinusoid to generate phase-shifted signals, thereby achieving similar benefits.

Integrated Receiver Circuit

Figure 4A:
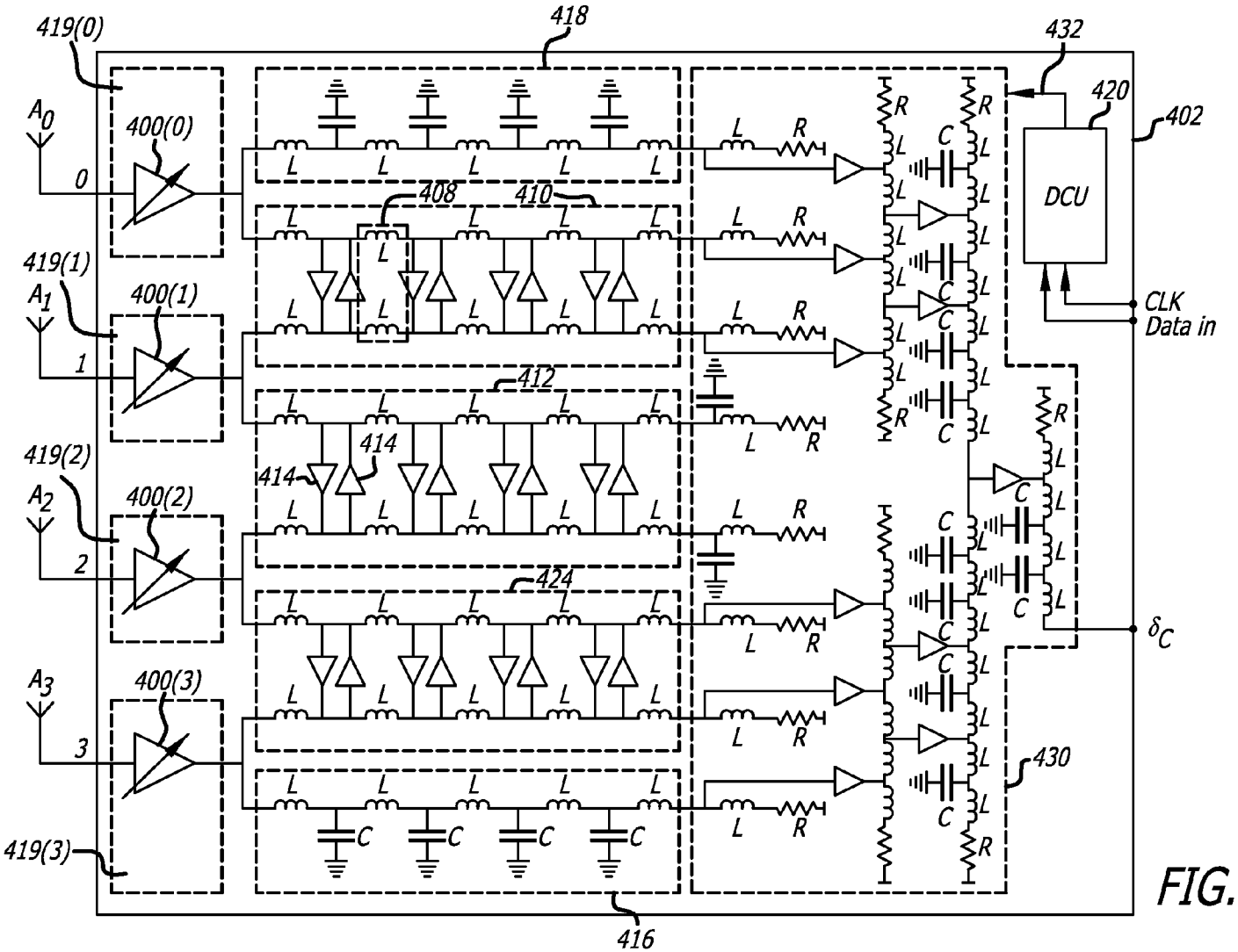
FIG. 4A is a schematic diagram of an integrated four channel UWB receiver circuit.

FIG. 4*a* depicts a circuit schematic of the four channel integrated receiver circuit 402 shown in FIG. 2. Inputs at channels 0-3 of the receiver 402 are coupled to antennas A0-A3, respectively. The input stages 419(0)-(3) of the receiver embodiment shown in FIG. 4*a* include variable-gain low-noise amplifiers (LNAs) 400(0)-400(3). Note that, in other embodiments, the input stages 419(0)-(3) may include other or additional circuit components, as known in the art, for receiving signals or conditioning received signals, such as filters, demodulators, other types of amplifiers, converters, and the like. LNAs 400(0)-400(3) equalize signal power losses on different channels. In one configuration, LNAs 400(0)-400(3) comprise four main parts: a third-order passive input matching network, a shunt-shunt resistive feedback differential pair, a shunt-peaked differential pair cascade, and a differential pair dummy section. Such a configuration may be used to achieve an ultra-wide bandwidth with a constant group delay, while minimizing noise. The design and implementation of the LNAs 400(0)-400(3) is within the contemplation of those skilled in the art.

Receiver circuit 402 further includes matched transmission path lines 418 and 416 and variable delay elements 410, 412, and 424, UWB active combiner 430, and digital control unit (DCU) 420. In the embodiment shown, variable delay elements 410, 412, and 424 are trombone delay elements, although various other types of delay elements may be equally suitable. For example, in one embodiment, digital delay elements are used to provide the delay paths for the circuit.

DCU 420 includes a clock and data input, as well as a control output 632. Control output 632 is conceptually illustrated here for clarity. In an actual implementation, control output may 632 may be a plurality of conductive traces routed to one or more or combiner elements, delay elements, delay cells, path amplifiers, etc. for adjusting one or more circuit parameters. In one aspect, DCU 420 may be used to control delay values. DCU 420 may also be used to control the gain of the input stages, or other variables.

DCU may include a discrete block of digital logic integrated into the receiver chip. Alternatively, in some embodiments it may reside on a different chip. In other embodiments it may be included on a different chip but on a single module. DCU may be fabricated using application specific integrated circuits, DSPs, general purpose processors, simple digital logic blocks, or some other technology. In one embodiment, DCU is linked to a memory that runs executable code for controlling characteristics such as the magnitude of the variable delay to introduce into the received UWB signals. DCU may alternatively or additionally be linked to and controlled by an external computer. The desired setting for gain in the variable gain LNAs and for the delays may be stored in on-chip shift registers that may be programmed off chip using a computer interface.

Matched transmission path lines 418 and 416 include networks of inductors L and capacitors C. Trombone delay elements 410, 412, and 424 include a ladder network of inductors L and capacitors (not explicitly shown). Terminating resistors R, inductors L and capacitors C are shown in UWB active combiner 430. The values of L, C, and R throughout the receiver 402 typically vary, individually and/or collectively, depending on the implementation.

The three trombone delay elements 410, 412, and 424 correspond, respectively, to variable delay elements TTD0-TTD2 of FIG. 2. The variable delay elements may be implemented, as in FIG. 4*a*, as a quasi-distributed transmission line. Within each of the trombone delay elements 410, 412, and 424 is a number of delay cells 408.

FIG. 4*a* also shows an array of back-to-back path select amplifiers (PSAs) 414. PSA pairs 414 are used at each node to create a relative positive or negative time shift between adjacent channels, depending on the direction of the angle of incidence.

While UWB combiner 430 is illustrated in FIG. 4*a*, another type of combining element may be implemented without departing from the scope of the present disclosure. The function of UWB combiner 430 is to combine the signals on all channels under certain circumstances (e.g., when the incident wave is normal) to produce a coherent waveform. The UWB combiner 430 in this implementation is also a quasi-distributed transmission line, implemented as such in order to accommodate an ultra-wide bandwidth. The function of combiner 430 is distinguishable from the local combining of the signals as illustrated by $C_1$-$C_N$ in FIG. 3.

Figure 4B:
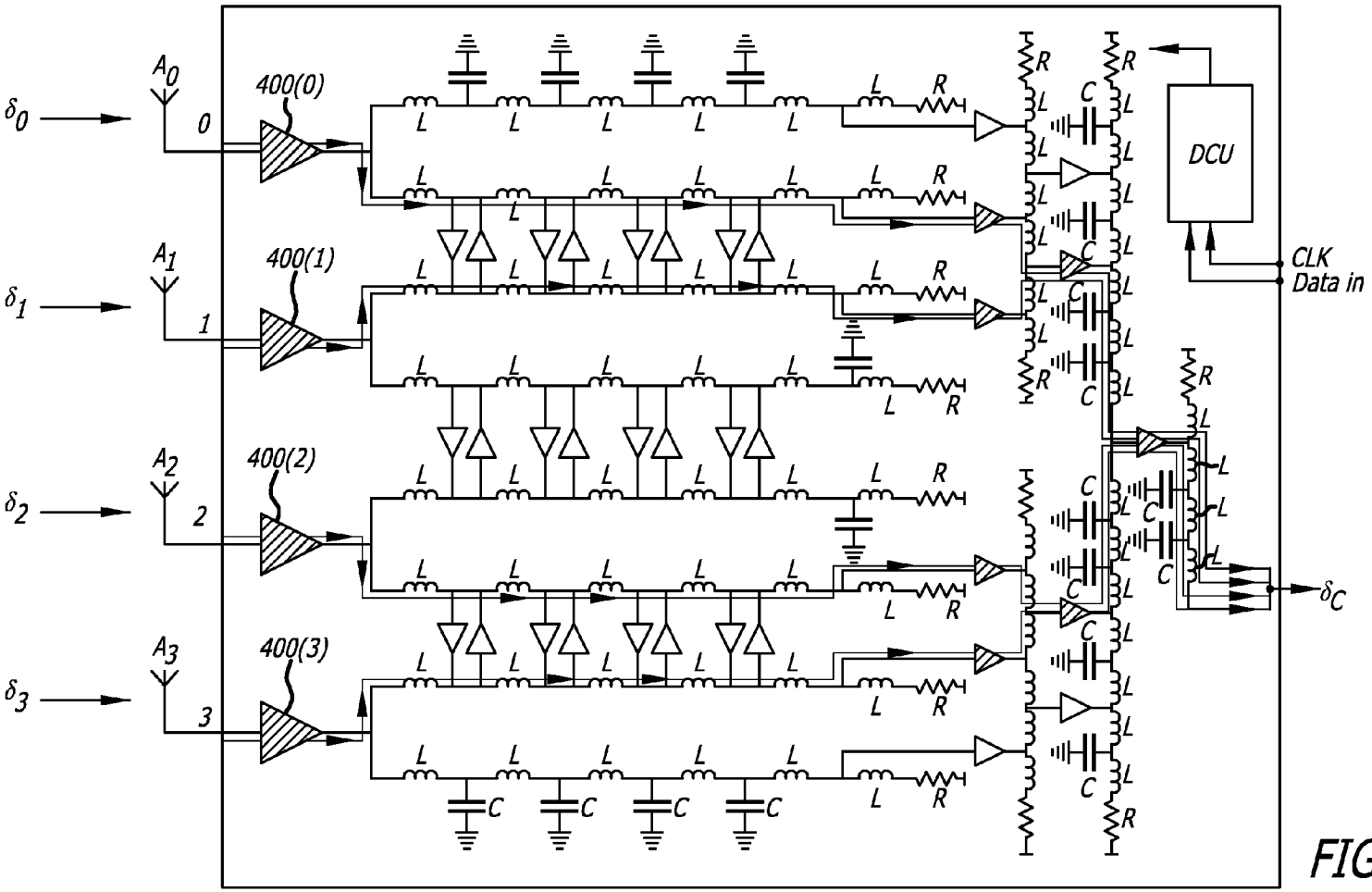
FIG. 4B is a schematic diagram of the UWB receiver circuit shown in FIG. 4A, illustrating a UWB normal wavefront arriving at a linked antenna array.

FIG. 4*b* shows an illustration of the integrated receiver circuit 402 in the case where an incident wave δ arrives at the array A0-A3 of antennas coupled to the four channels 0-3 of the receiver. Here, the incident wave δ is normal to the array, and components $\delta_0$-$\delta_3$ arrive at the antenna elements at the same time relative to one another. After passing through LNAs 400(0)-400(3), the signals traverse the various stages of the quasi-transmission line elements.

The shaded amplifier symbols represent the amplifier components through which the signals traverse in FIG. 4*b*. Similarly, the paths containing arrows represent the route of each signal for each of channels 0-3. The normal angle of incidence presents a simple case, because in general, the received UWB signals are not time-shifted relative to one another. The signals for all four channels 0-3 propagate through identical lengths of transmission lines with matched delays. Therefore, all four signals are combined coherently at the output combiner.

After traversing identical lengths of the delay elements, the signals on channels 0 and 1 are combined at node 405. Similarly, the signals on channels 2 and 3 are combined at node 407. The two sets of signals are combined at node 409, where the combined signal is routed through the remaining amplifier stage and passive components to produce coherent output waveform $\delta_C$.

Figure 4C:
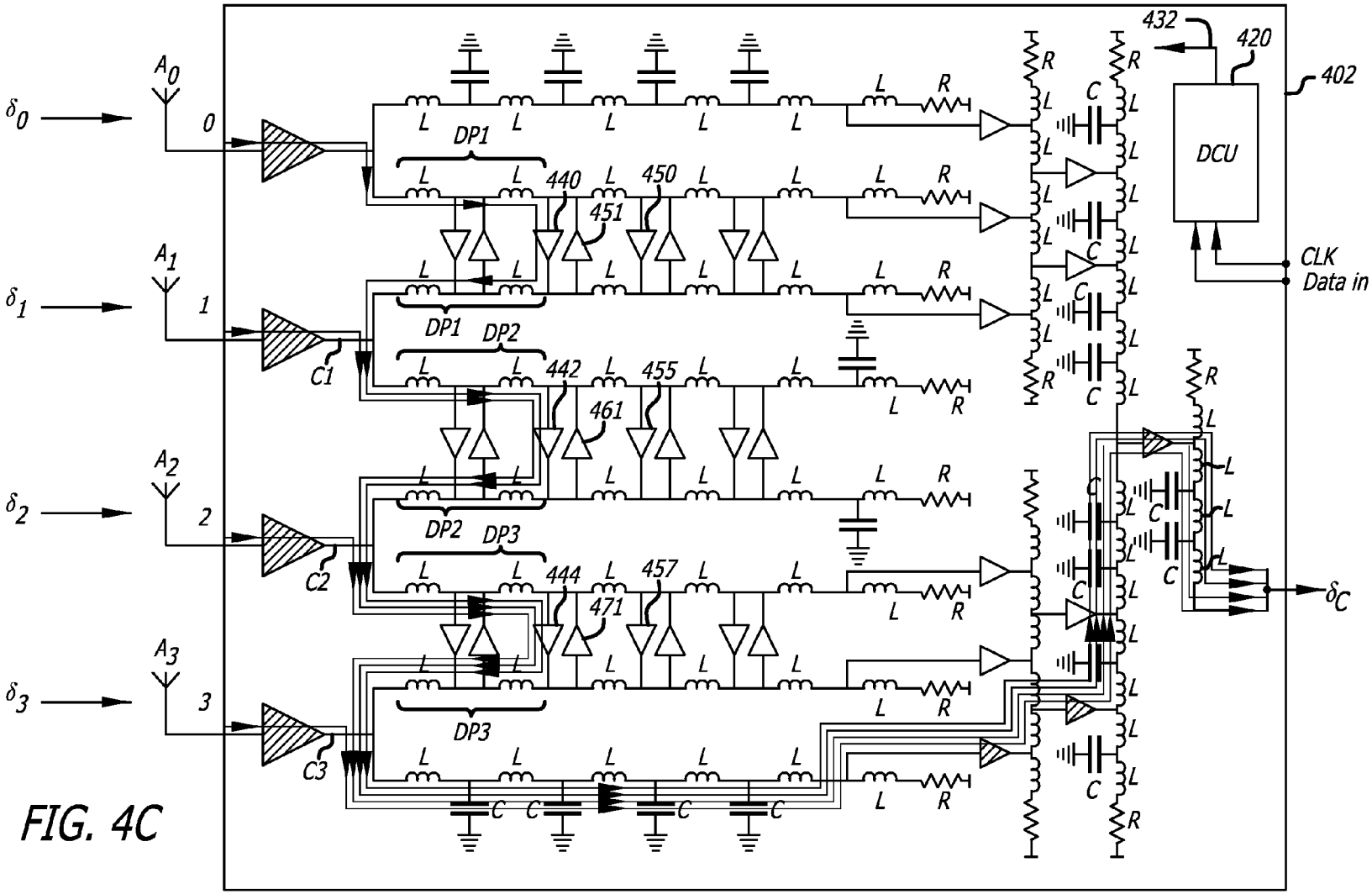
FIG. 4C is a schematic diagram of the UWB receiver circuit shown in FIG. 4A; illustrating a UWB wavefront arriving at a linked antenna array at an incident angle $\alpha$.

FIG. 4*c* shows an illustration of the integrated receiver circuit 402 receiving an ultra-wideband wavefront δ at some incident angle α. Following LNAs 400(0)-(3), the signal from each channel 0-3 is first time-shifted and then combined locally with the signal in the adjacent channel. In one embodiment, the magnitude of the time shift may be controlled by DCU 420, which provides a control signal on line 432 to the variable delay elements as discussed above. More specifically, depending on the perceived incident angle of the incoming wavefront, the DCU may activate certain PSAs, such as path select amplifiers 440, 442 and 444, and turn off or maintain off all remaining PSAs (such as path select amplifiers 450, 455, 457, etc.), in order to set the desired delay path to compensate for the incident angle of the wave. The DCU 420 may also arbitrate between two directions of PSAs, such as selecting path select amplifiers 440, 442 and 444 to create a relative positive delay for each channel, or selecting PSAs 451, 441, and 471 to create a relative negative delay for each channel. Such a directional change may be used, for example, when the direction of the incident wavefront changes.

In FIG. 4*c*, DCU 420 selects PSAs 440, 442, and 444 to create a time shift to compensate for the relative time delay caused by the incident angle $\alpha$. Thus, each of the signals on channels 0-2 traverses a respective delay path DP1-DP3, each characterized in this example by two inductors of inductance L, a PSA (either 440, 442, or 444), and two more inductors of inductance L. Each of the delay paths DP1-DP3 are part of a respective one of the variable delay elements 410, 412, and 424 as identified in FIG. 4*a*.

Depending on the value of the angle of incidence and possibly other characteristics, a smaller or larger time shift may be required. The time shift can be adjusted in the embodiment shown by changing which PSAs are active at any given time. For a smaller time delay, a smaller delay path may be needed. Correspondingly, for a larger time delay a larger path may be necessary. The variable time delay elements can be adjusted to accommodate the necessary delay. For example, in one implementation, for steeper incident angles, the path select angles further down the delay elements may be activated to achieve a greater incremental delay difference between adjacent channels. It can be appreciated that various delay cells can be considered active or inactive (i.e. will conduct current or not) depending on whether certain PSAs are active).

After a first time-shifted signal is generated from the signal on channel 0 in FIG. 4*c*, it is locally combined at node C1 with the processed signal on adjacent channel 1. In the embodiment of FIG. 4*c*, the combining function is performed by virtue of the delay elements and the quasi-distributed transmission line architecture. The path select amplifiers tap the signal voltage from the appropriate point along the delay line to set the delay as described above. The signal voltage is then injected into the delay line in the adjacent channel as a current, thereby combining the signal on one channel with the signal in the adjacent channel.

The combined signal traverses the delay path DP2 to produce a second time-shifted signal and is thereafter locally combined with the processed signal on adjacent channel 2 at C2. There again, the combined signal, now including the first and second time-shifted signal as integrated components, is passed to delay path DP3, where a third time-shifted signal is produced and is locally combined with the processed signal 3 at C3. The third time-shifted signal includes the time shifts from all three delay paths. In the embodiment shown, the delay paths are each matched, so that the propagation delays can be well controlled. Thus, in FIG. 4*c*, a linear delay progression from the first to the fourth channel is maintained.

The combined signal of all four channels travels to the output through the quasi distributed transmission line at the bottom of FIG. 4*a*, and is routed through the output combiner to produce $\delta_C$.

Integrated Transmitter Circuit

Figure 5:
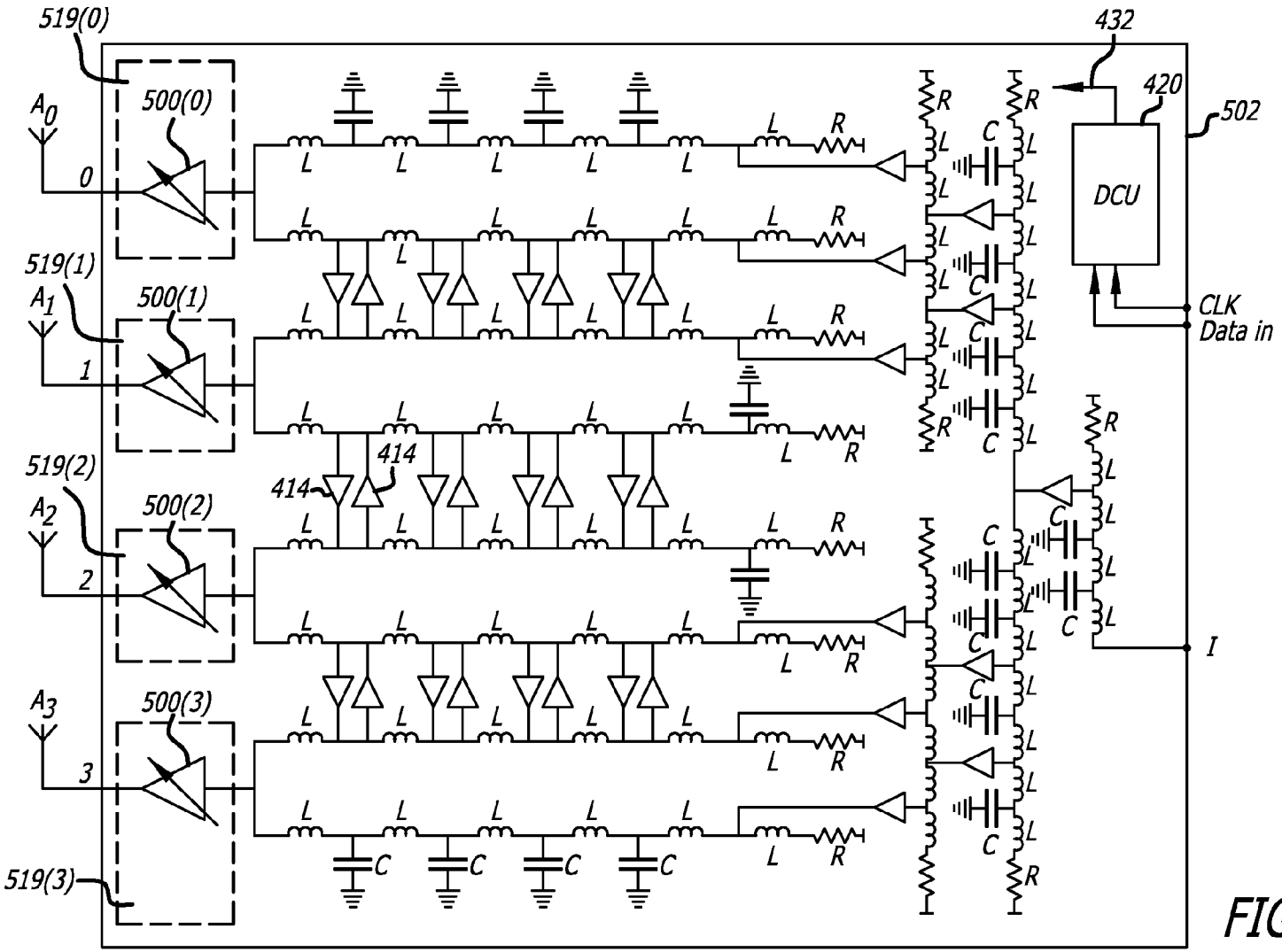
FIG. 5 is a schematic diagram of an integrated four channel UWB transceiver circuit.

FIG. 5 shows a circuit schematic of an integrated transmitter circuit 502. The integrated circuit 502 is similar as the embodiment shown in FIG. 4, except that the integrated circuit 502 is configured to perform a transmit function. Integrated circuit 502 includes output stages 519(0)-519(3) coupled to each of antennas $A_0$-$A_3$ for transmitting time-shifted wireless signals. Each input stage 519(0)-519(3) includes one of amplifiers 500(0)-500(3) for transmitting the wireless signal via the antennas. An input waveform I traverses the components of the output combiner, which now functions as a splitter. DCU 420 activates the desired PSA sets using output 432 to select the desired delay path in the delay elements. The input waveform I is transmitted wireless over channels 0-3 as four signals time-shifted relative to one another.

Integrated Transceiver Circuit

Figure 6:
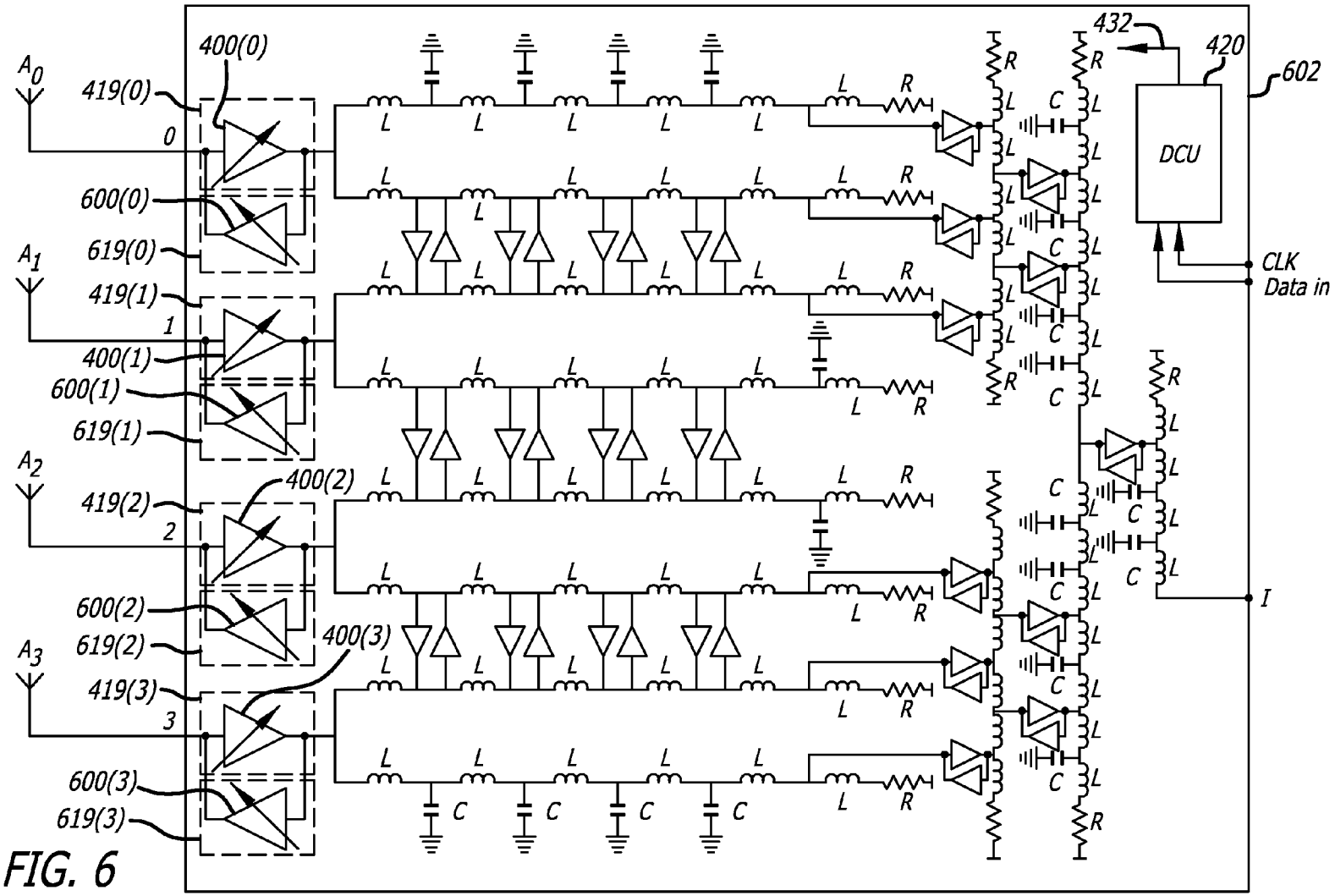
FIG. 6 is a schematic diagram of an integrated four channel UWB transmitter circuit.

FIG. 6 shows a circuit schematic of an integrated transceiver circuit 602, which incorporates the functionality of both the transmitter 402 and the receiver 502 of FIGS. 4 and 5, respectively. Transceiver 602 includes both input stages 419(0)-(3) and output stages 619(0)-(3), each of which include respective amplifiers 400(0)-(3) and 600(0)-(3) for transmitting and receiving respective time-shifted signals over antennas $A_0$-$A_3$. The delay elements remain the same in the embodiment and the signal paths may be used in both directions, except that the amplifiers in the output combiner stage such as 690 now reside in pairs to enable signal flow in both directions.

In an integrated circuit such as the ones shown in FIGS. 4-6, delay elements 410, 412 and 424 may be substituted with digital delay elements as well as other types of delay elements.

Delay Path Interconnection

Figures 1, 7:
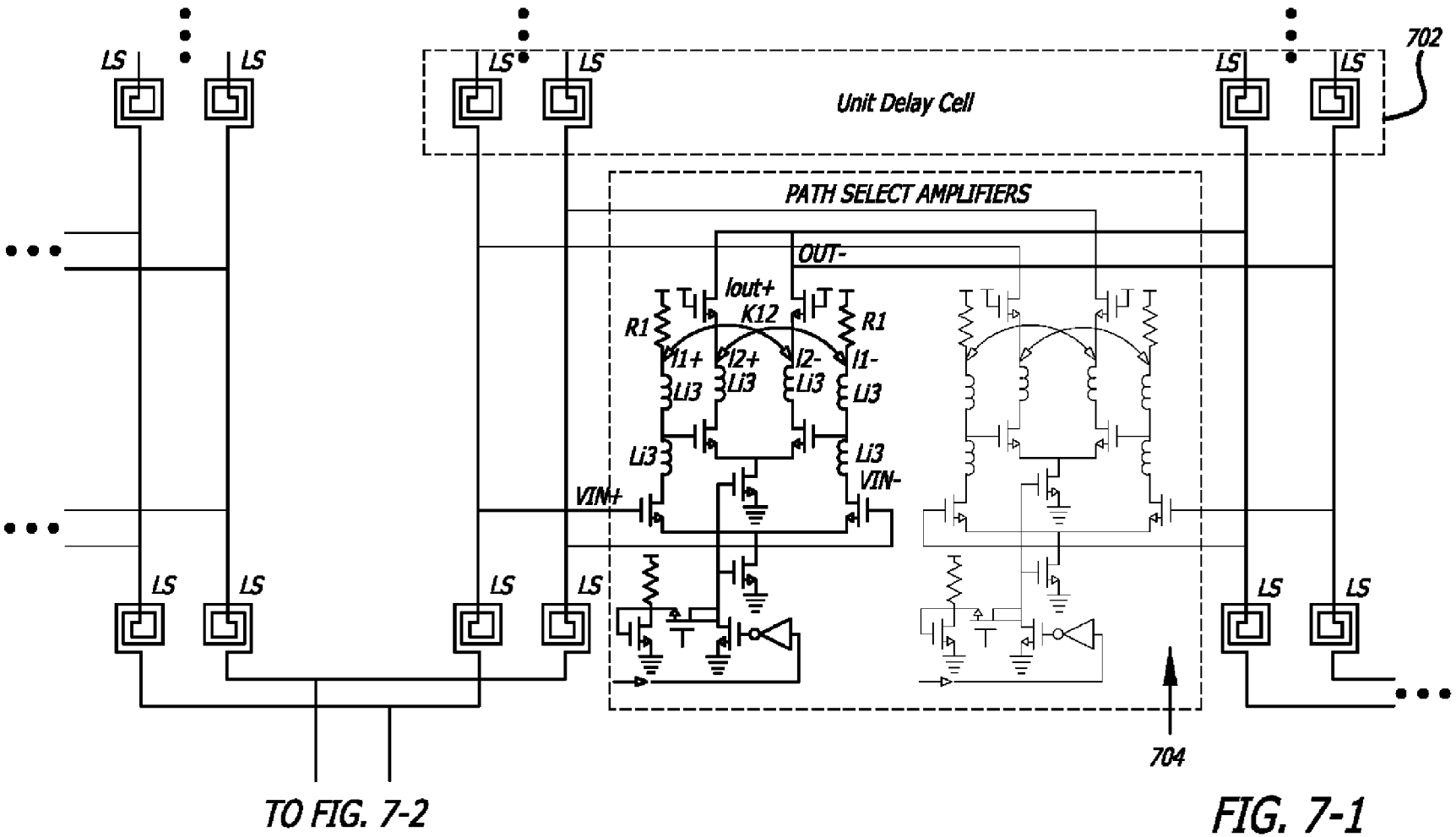
FIG. 7 is a schematic diagram of an interconnection of a unit delay cell, path select amplifier, and low noise amplifier in an illustrative UWB receiver circuit.
Figures 2, 7:
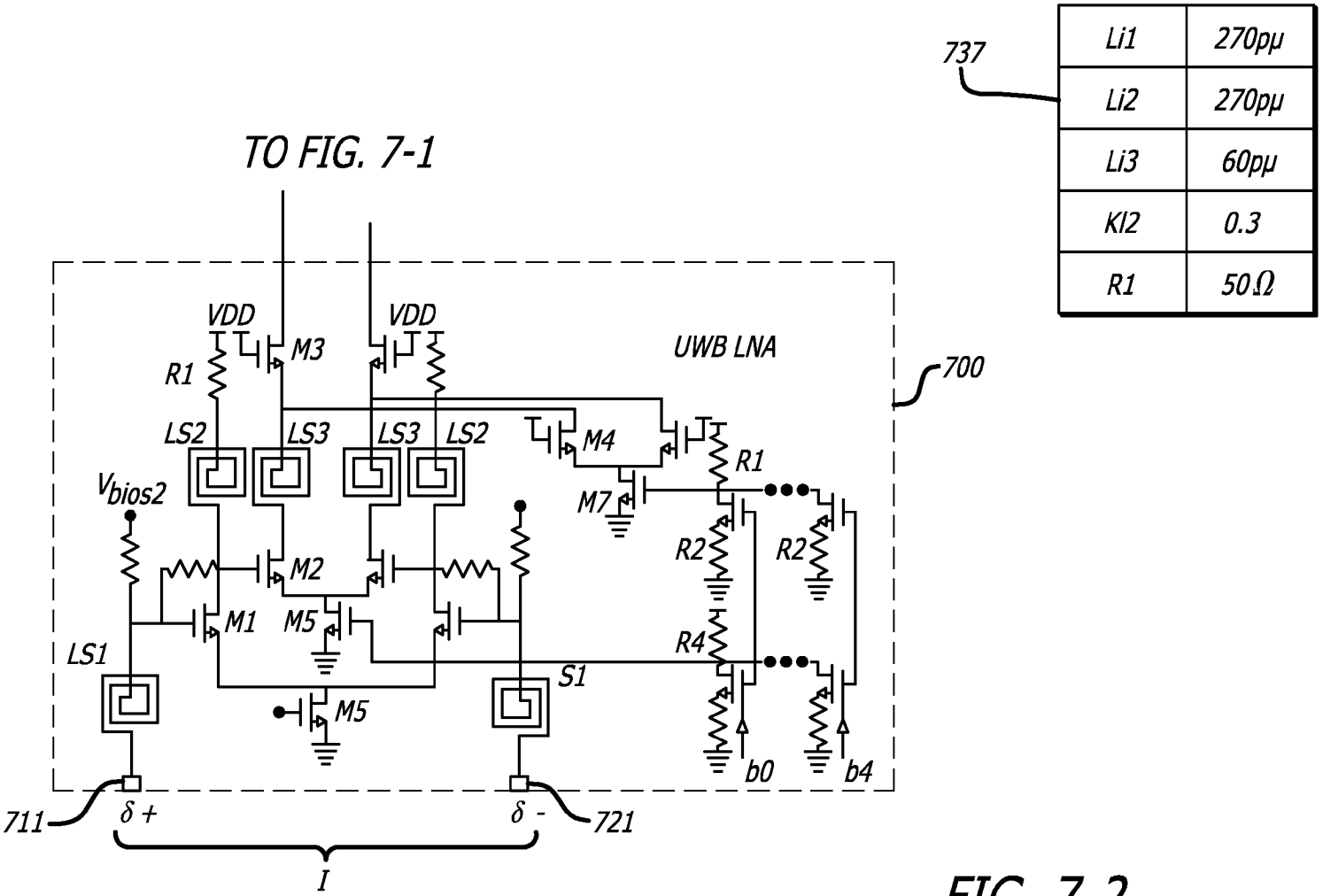

FIG. 7 depicts a circuit diagram of an exemplary interconnection of an ultra-wideband LNA 700, unit delay cell (UDC) 702, and PSAs 704 for a single channel. Each of LNA 700, UDC 702 and PSA 704 is of the type that may be used in an embodiment such as that of FIG. 4-6. Referring to LNA 700, in one embodiment, the signal path is differential. The desired settings for gain may be stored in on-chip shift registers as described above. An input $\delta$, which includes differential inputs $\delta+$ and $\delta-$, is received on input pads and 721 corresponding to a channel. Each LNA 700 amplifies the current associated with signal $\delta$ from each channel and injects the amplified current through the inductors $L_S$ into the shared delay element in active UDCs 702. Each active PSA taps the signal voltage from an appropriate point along the delay element on the left side or the right side as applicable. The tapped voltage is then injected into the delay element on the adjacent channel on the corresponding right side or the left side as a current.

Figure 8A:
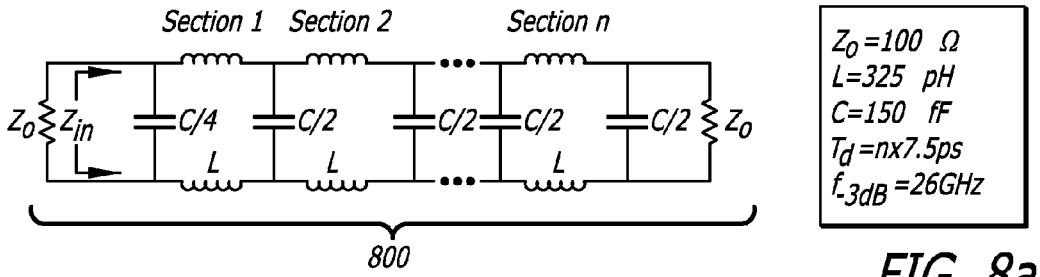
FIG. 8A is a conceptual diagram of a delay element.
Figure 8B:
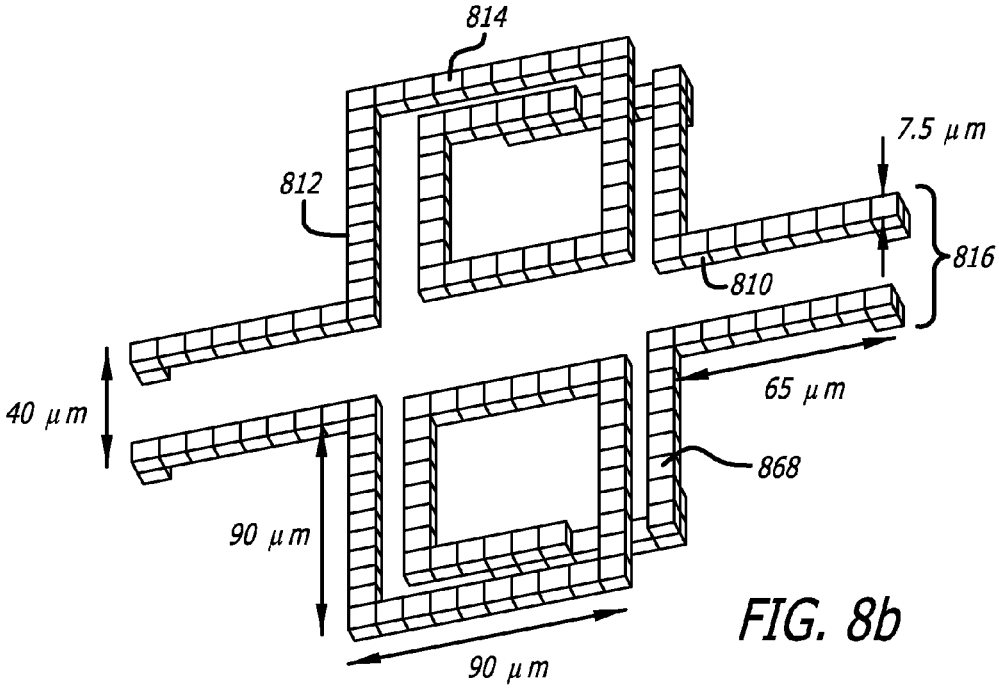
FIG. 8B is a view of on-chip spiral inductors.

In an aspect, a delay element may include a fully differential constant k shared LC ladder structure 800, as shown in the embodiment of FIG. 8. The delay of this structure is approximately $T_D=n\sqrt{LC}$, where n is the number of LC sections. The impedance of the delay line within the bandwidth of interest is $Z_0=\sqrt{L/C}$ (and the cutoff frequency of the delay element is $2/\sqrt{LC}$. The ladder structure 800 may be used to model one of delay elements 410, 412 and 424 in FIG. 4*a*.

In one implementation realized by the inventors, the differential delay lines of delay element 800 were designed for a characteristic impedance of $Z_0=100\Omega$. The delay of each LC section 1 through section n was 7.5 ps. For each delay setting, the delay of two sections on either side of PSAs 704 result in 15 ps of delay difference resolution. Therefore, the appropriate values for the differential inductor L and capacitor C/2 at each section in this example are 750 pH and 75 fF, respectively, resulting in a line cutoff frequency of approximately 26 GHz. Values for path select amplifiers according to one embodiment are shown in table 737.

On Chip Spiral Inductor

In an aspect, the inductors in delay element 800 may be implemented as an on-chip spiral inductor, such as that shown in FIG. 8. In the embodiment shown, 750 pH on chip spirals are implemented. The parasitic capacitance forms the inductors and the input and output ports of the PSAs 704 (FIG. 7) form the capacitance of the quasi-distributed transmission line. In one embodiment, the PSAs 704 are configured to maintain an almost constant capacitance in either the on or the off state. The delay elements are terminated to 100Ω loads to provide the correct impedance at each point and to eliminate the unwanted signal reflections. Therefore, the line characteristic impedance may be kept substantially constant for all delay setting.

Figure 8C:
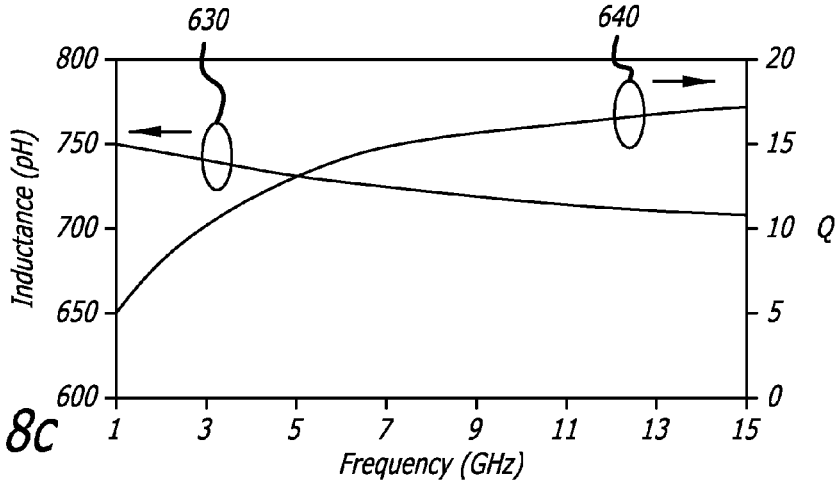
FIG. 8C is a plot inductance-frequency plot of the on-chip spiral inductors of FIG. 8B.

FIG. 8*c* shows a plot of inductance of the spiral inductor of FIG. 6*b* versus frequency of the received waveform. As can be seen at points 830 and 840, the simulated differential quality factor of the 750 pH inductors provides for a differential quality factor several times greater than an ultra-wide bandwidth. Accordingly, using the selected inductors, a high bandwidth can be accommodated.

CMOS Integrated Circuit Layout

Figure 9:
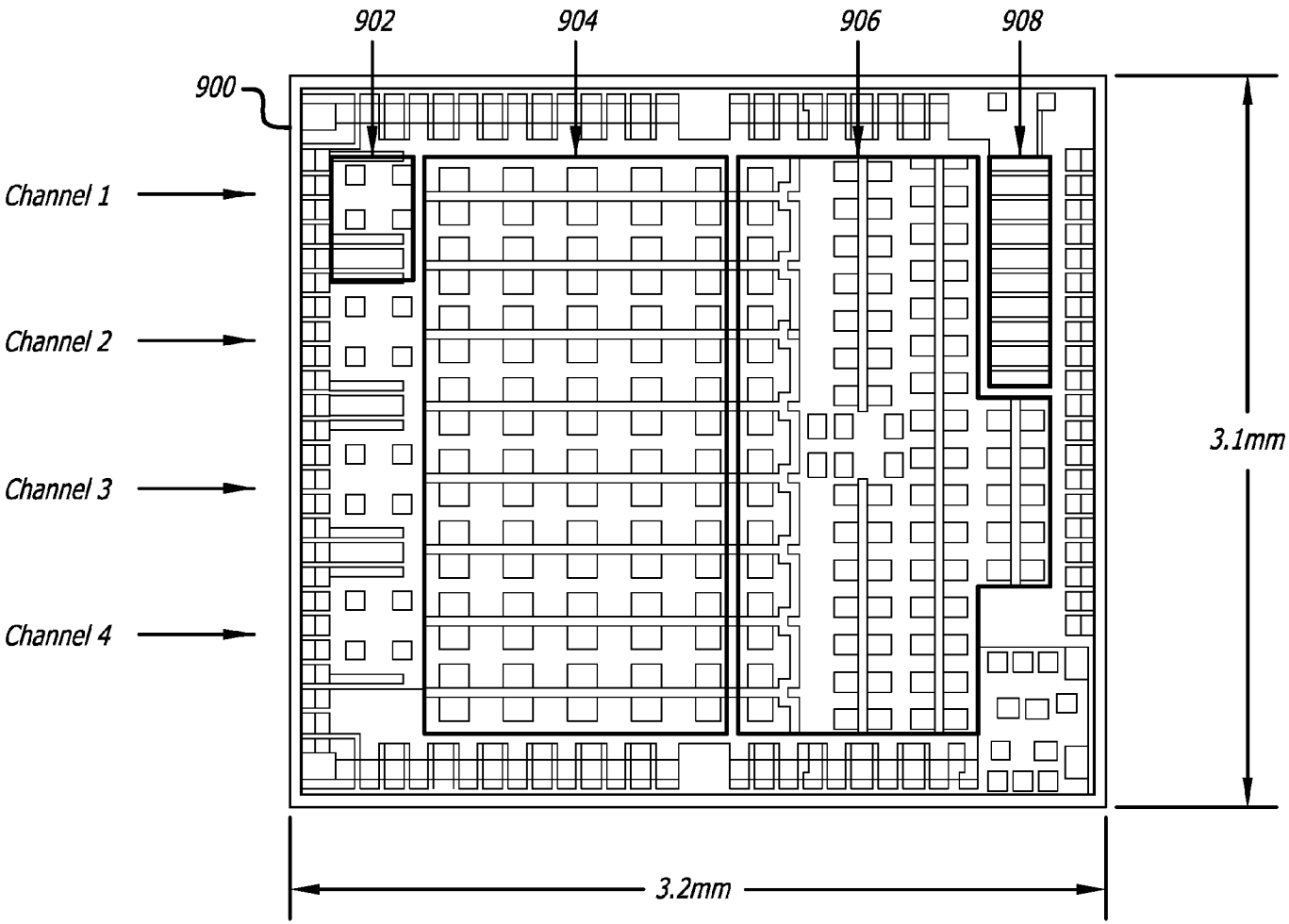
FIG. 9 is a conceptual block diagram of a layout of an integrated UWB receiver circuit.

An illustrative layout of the integrated circuit 900 of FIG. 4*a* as implemented by the inventors is shown in FIG. 9. The LNA topology 902 in the embodiment shown includes four main parts: a third-order passive input matching network, a shunt-shunt resistive feedback different pair, a shunt-peaked differential pair cascode, and a differential pair dummy section. Four such blocks are repeated on the left side of the circuit 900. The LNA design methodology was to achieve an ultra wide bandwidth and constant group delay while minimizing the noise figure. The shunt-shunt resistive feedback amplifier and a third-order passive network at the input are used to achieve input impedance matching over an ultra wide bandwidth.

The output of the LNA drives the path-sharing delay structures 904, which in this implementation are shared tapped delay trombone lines.

Each UWB path-select amplifier is a fully differential two stage design. The mutual coupling between the slabs is exploited to enhance the bandwidth. The slab inductors are implemented vertically on two close metal layers to maximize their coupling.

The input and output capacitance of the path-select amplifiers are absorbed into the design of the quasi-distributed transmission lines. The differential capacitance at each node of transmission line is 74.7 fF and is formed by the parasitic capacitance of input and output capacitances of the back-to-back path select amplifier and transmission line inductors. The differential input and output capacitances of the path select amplifier is 19.3 fF and 47.12 fF when it is off and 30.12 fF and 52.3 fF when it is on, respectively. The capacitance at each node may change by a maximum of 15% due to turning the path-select amplifiers on and off. This variation has negligible impact on system performance.

UWB active signal combiner 906 and DCU 908 are also shown, as well as the I/O pads extending around the circumference of the circuit 900. Based on the use of the shared delay architecture, the inventors were able to achieve an integrated receiver circuit having only a surface area of 3.1 mm×3.2 mm.

Figure 10:
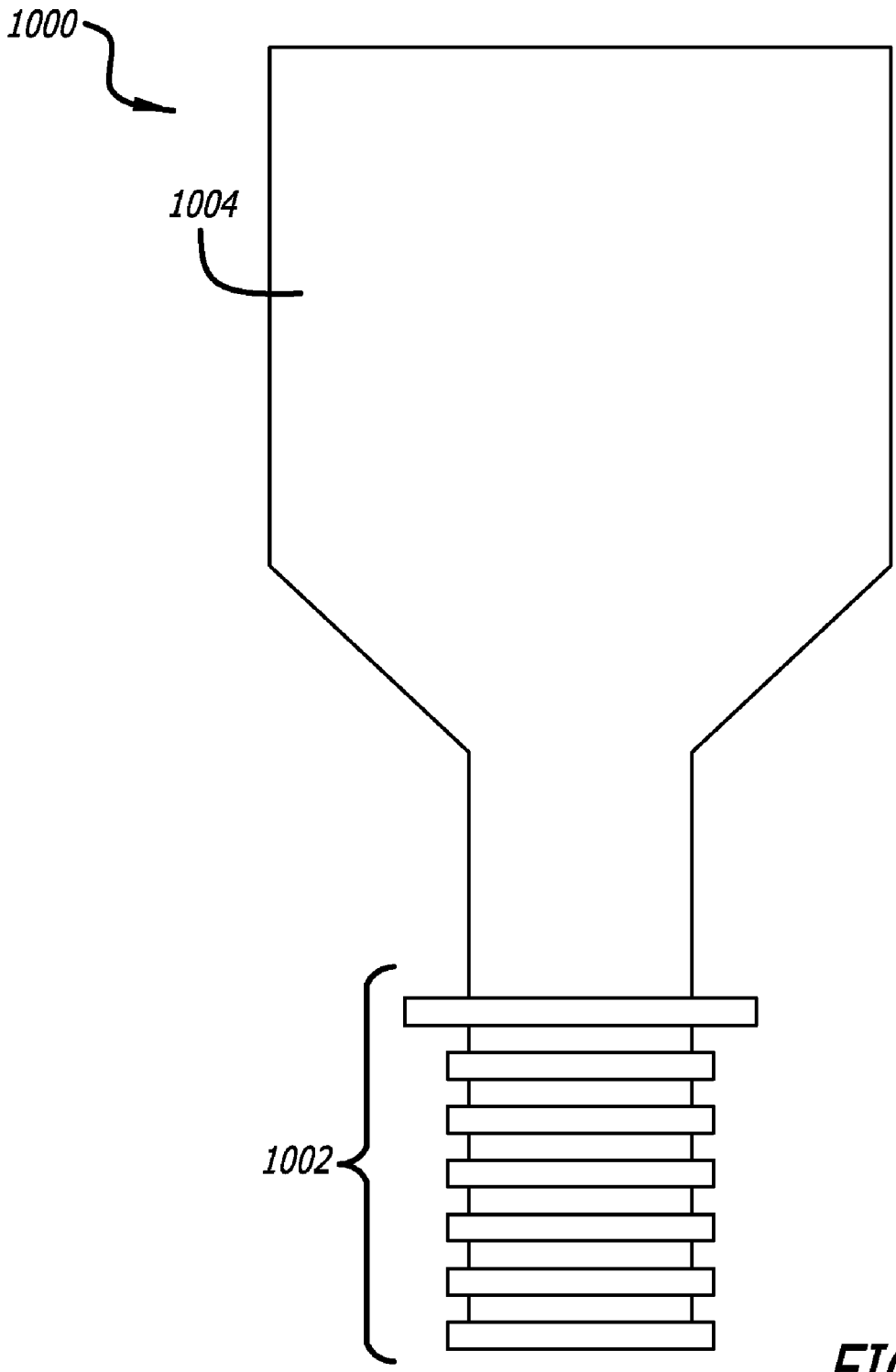
FIG. 10 is an illustration of a planar antenna.

FIG. 10 is an illustration of a planar antenna 1000 that may be used in one embodiment as part of an array for coupling to a transceiver circuit as described herein. The antenna 1000 includes conducting body 1004 and a fastening element for affixing the antenna to a module or board associated with the transceiver. A wide variety of antenna types may be contemplated by those skilled in the art, depending on the wireless technology involved and on the application.

While certain embodiments have been described herein, it will be understood by one skilled in the art that the methods, systems, and apparatus of the present disclosure may be embodied in other specific forms without departing from the spirit thereof.

Accordingly, the embodiments described herein, and as claimed in the attached claims, are to be considered in all respects as illustrative of the present disclosure and not restrictive.

What is claimed is:

1. A receiver for processing wireless signals, each received by a different one of an array of spaced-apart antennas and being offset in time or phase relative to the others, the receiver comprising a circuit comprising:

a plurality of different channels, each comprising an input stage for processing a different one of the wireless signals as received by a different one of the antennas; and a delay element coupled to each input stage, the delay element comprising a delay path for producing a shifted version of the received wireless signal; wherein a delay path on one channel is used to generate a shifted signal on an adjacent channel.

2. The receiver of claim 1, further comprising a plurality of output stages, each output stage being associated with a respective one of the channels and configured to process an outgoing wireless signal to be transmitted over the antennas.

3. The receiver of claim 1, wherein the delay elements comprise a variable true time delay element.

4. The receiver of claim 1, wherein the delay elements comprise a digital delay element.

5. The receiver of claim 1, wherein the delay elements comprise a tapped-delay trombone line.

6. The receiver of claim 1, wherein the delay elements are integrated on a single integrated circuit.

7. The receiver of claim 1, wherein the delay elements comprise one or more passive components.

8. The receiver of claim 1, wherein the delay elements comprise a quasi distributed transmission line.

9. The receiver of claim 1, further comprising a digital control unit configured to select the delay paths.

10. The receiver of claim 1, wherein the wireless signals comprise ultra-wideband signals.

11. A receiver or transmitter for processing ultra-wideband signals received or transmitted, respectively, by a different one of an array of spaced-apart antennas and being offset in time or phase relative to the others, comprising an integrated circuit comprising:

a plurality of different channels for conditioning ultra-wideband signals, the signals being shifted in time relative to one another, each channel have an input or an output configured to be connected to a different one of the antennas; and a delay element on each channel for producing a time shifted signal; wherein a common delay element is used to produce time-shifted signals on more than one channel.

12. The receiver or transmitter of claim 11, wherein the channels are further configured to condition a corresponding plurality of outgoing ultra-wideband signals to be wirelessly transmitted, the ultra-wideband signals being shifted in time relative to one another.

13. The receiver or transmitter of claim 11, wherein the delay elements comprise a digital delay element.

14. The receiver or transmitter of claim 11, wherein the delay elements comprise one or more passive components.

15. The receiver or transmitter of claim 11, wherein the delay elements comprise a quasi distributed transmission line.

16. The receiver or transmitter of claim 11, further comprising a digital control unit configured to select the delay paths.

17. A timed array receiver, comprising:

first and second spatially adjacent antennas of a plurality of different antennas in an array, the first and second antennas configured to receive first and second wireless signals, respectively, the signals originating from an incident wavefront arriving at the antennas at a time delay relative to one another, the time delay being a function of an angle of the incidence, the first signal arriving first;

first and second input stages respectively coupled to the first and second antennas for processing the first and second received signals on different channels;

a first delay element coupled to the first input stage for producing a first time shifted signal from the first processed signal;

a second delay element coupled to the second input stage for producing a second time shifted signal, wherein the second time shifted signal comprises a combination of the first time shifted signal and the second processed signal.

18. The receiver of claim 17, further comprising:

a third input stage coupled to a third antenna for receiving a third wireless signal, the third antenna spatially adjacent to the second antenna, the third input stage for processing the third received signal;

a third delay element coupled to the third input stage for producing a third time shifted signal; wherein the third time shifted signal comprises a combination of the second time shifted signal and the third processed signal.

19. The receiver of claim 17, wherein the delay elements comprise one or more passive components.

20. The receiver of claim 17, wherein the delay elements comprise a quasi-distributed transmission line.

21. The receiver of claim 17, wherein the delay elements comprise one or more path select amplifiers.

22. The receiver of claim 17, wherein the delay elements comprise a variable true time delay element.

23. The receiver of claim 17, further comprising a digital control unit configured to select a delay path in the delay elements.

24. The receiver of claim 17, wherein the antennas comprise ultra-wideband planar antennas.

25. A receiver for processing wireless signals, each received by a different one of an array of spaced-apart antennas and arriving at the array in sequence of one of phase or time as a function of an angle of an incident ultra-wideband wavefront, the receiver comprising a circuit comprising:

a plurality of different channels, each channel comprising an input, each input being configured to receive the signal from a different one of the antennas;

delay elements, each delay element configured to introduce a delay into an earlier received signal on one of the channels to provide a shifted signal to an adjacent channel on which a received signal is delayed in phase or time; and a combining element coupled to each delay element; wherein at least one common delay element is configured to introduce the delay into received signals on more than one channel to provide a shifted signal to the more than one channel.

26. The receiver of claim 25, wherein the wireless signals comprise ultra-wideband signals.

27. The receiver of claim 25, wherein the wireless signals comprise narrowband signals.

28. The receiver of claim 25, wherein the delay elements comprise variable phase shifters.

29. The receiver of claim 25, wherein each channel further comprises an output configured to transmit outgoing signals via the antennas, the outgoing signals comprising shifted signals.

30. The receiver of claim 25, further comprising a digital control unit configured to select a delay path in the delay elements.

31. The receiver of claim 25, wherein the antennas comprise ultra-wideband planar antennas.

32. A wireless transmitter for transmitting a plurality of wireless signals, each from a different one of an array of spaced-apart antennas and being offset in time or phase relative to the others, the wireless transmitter comprising:

a plurality of different channels, each channel being configured to be coupled to a different one of the antennas;

a first delay element configured to generate a first shifted signal from a first input signal on a first channel, the first shifted signal being split into first and second split shifted signals; and a second delay element configured to generate a second shifted signal from the second split shifted signal on a second channel, the second shifted signal being split into second and third split shifted signals; wherein the first and second split shifted signals are configured to be transmitted over the antennas coupled to the first and second channels, respectively.

33. The transmitter of claim 32, wherein the first and second delay elements comprise a variable true time delay element.

34. The transmitter of claim 32, wherein the delay elements comprise a digital delay element.

35. The transmitter of claim 32, wherein the delay elements comprise a tapped-delay trombone line.

36. The transmitter of claim 32, wherein the delay elements are integrated on a single integrated circuit.

37. The transmitter of claim 32, wherein the delay elements comprise a phase shifter.

38. The transmitter of claim 32, wherein the wireless signals comprise ultra-wideband signals.

39. A receiver for processing wireless ultra-wideband signals, each received by a different one of an array of spaced-apart antennas and being offset in time or phase relative to the others, the receiver comprising an ultra-wideband integrated receiver circuit, comprising:

a plurality of conducting terminals, each for coupling to a different one of the antennas over a different channel;

input processing circuits coupled to each conducting terminal;

variable delay means coupled to each of the input processing circuits for producing time-shifted signals; and combining means coupled to each of the variable delay means for producing net signals, wherein at least one common variable delay means provides a common delay path used to produce time-shifted signals on more than one different channel.

* * * * *